US006111958A

United States Patent [19]

Maher

[11] Patent Number: 6,111,958

[45] Date of Patent: Aug. 29, 2000

[54] AUDIO SPATIAL ENHANCEMENT APPARATUS AND METHODS

[75] Inventor: Robert Crawford Maher, Boulder, Colo.

[73] Assignee: EuPhonics, Incorporated, Boulder, Colo.

[21] Appl. No.: 08/822,302

[22] Filed: Mar. 21, 1997

[51] Int. Cl.[7] ..... H04R 5/00

[52] U.S. Cl. ..... 381/17; 381/1

[58] Field of Search ..... 381/17, 18, 1, 381/61, 63

[56] References Cited

U.S. PATENT DOCUMENTS

| | | | |
|---|---|---|---|
| 3,236,949 | 2/1966 | Atal et al. . | |
| 4,219,696 | 8/1980 | Kogure et al. . | |
| 4,748,669 | 5/1988 | Klayman . | |
| 4,841,572 | 6/1989 | Klayman . | |
| 5,046,097 | 9/1991 | Lowe et al. . | |
| 5,052,685 | 10/1991 | Lowe et al. . | |
| 5,121,433 | 6/1992 | Kendall et al. . | |
| 5,195,140 | 3/1993 | Kudo et al. | 381/63 |
| 5,235,646 | 8/1993 | Wilde et al. . | |
| 5,386,082 | 1/1995 | Higashi . | |
| 5,412,731 | 5/1995 | Desper . | |
| 5,420,929 | 5/1995 | Geddes et al. | 381/1 |
| 5,436,975 | 7/1995 | Lowe et al. . | |
| 5,438,623 | 8/1995 | Begault . | |
| 5,521,981 | 5/1996 | Gehring . | |
| 5,587,936 | 12/1996 | Levitt et al. . | |

*Primary Examiner*—Ping Lee
*Attorney, Agent, or Firm*—Jennifer L. Bales; Macheledt Bales & Johnson LLP

[57] ABSTRACT

A spatial enhancement system broadens the sound image of a stereo signal. The system emphasizes dissimilarity between the left and right channels by (i) boosting the level of the dissimilar components, (ii) providing spectral equalization to enhance the perception of breadth, and (iii) injecting an equalized, attenuated and inverted version of the dissimilar component into the opposite channel to broaden the components stereo image. The present invention avoids spectral coloration by providing a generally flat transfer function from input to output. Interchannel dissimilarity is estimated by performing a first order comparison of the left and right input signals. The comparison may be implemented by a peak detector on the L–R signal, a cross-correlation procedure, or some other scheme. As a feature, a feedback mechanism alters the equalization characteristics of the signals in a manner that is responsive to the dissimilarity of the output signals. For example, the level of the low frequency components is boosted when the left and right output signals are dissimilar. If the input signal is a monophonic signal, the system decorrelates the mono signal using cascades of all pass filters to generate a pseudo-stereo signal prior to spatial broadening.

14 Claims, 6 Drawing Sheets

AUDIO SPATIAL ENHANCEMENT APPARATUS AND METHODS

BACKGROUND OF THE INVENTION

1. Field of the Invention

The present invention relates to audio spatial enhancement.

2. Description of the Prior Art

Audio systems for two-channel stereo have been demonstrated for over 100 years. Among the first published references is the 1881 demonstration at the Paris Electrical Exhibition of the transmission of sound via telephone from the Grand Opera of Paris to a listening room located several kilometers away. Listeners in the remote location were provided with two telephone ear pieces, each driven by a separate microphone located on the stage of the opera, through which the opera performance could be auditioned with remarkable clarity. Listeners were able to distinguish each individual singer and reported that the aural impressions changed with the relative positions of the singers, and their movements could be followed.

A major development in two-channel stereo sound was taught in British Pat. No. 394,325 (1931 by Blumlein). This patent describes a two-channel microphone system to control automatically the sound intensities of multiple loudspeakers such that the listener's ears detect low frequency phase differences and high frequency intensity differences which give the impression of a sound source emanating from the same direction as the original source. One embodiment involved a pair of nearly coincident bi-directional microphones which have their electrical outputs connected to generate a sum and difference signal pair. Additional circuitry to adjust the sum and difference signals has been used to alter the spatial qualities of the derived stereo audio signals. Boosting the difference signal to broaden the perceived stereo image was used more extensively starting in the late 1950's after stereo recording and broadcasting was introduced.

A side effect of the introduction of two-channel stereo reproduction systems in the consumer marketplace was a growing interest in mono-to-stereo conversion schemes that would create pseudo-stereo signals from a pre-existing monophonic recording. Several well-known methods include (a) sending the mono signal directly to one output channel while sending a slightly delayed or phase shifted version to the other channel, (b) sending a low pass filtered version of the mono signal to one channel and a high pass filtered version to the other channel, (c) sending a comb filtered version of the mono signal to one channel and a version processed by a complementary comb filter to the other channel, and (d) creating an incoherent pair of output signals by passing the mono input signal through separate channels of a stereo reverberation system.

Prior art stereophonic enhancement inventions combine left (L) and right (R) channels with processed versions of L+R and L−R in empirically determined proportions. All of these systems therefore suffer from one or more of the following drawbacks:

(a) The enhancement process is based largely upon empirical results or trial-and -error parameters, which makes systematic improvements and alterations unwieldy.

(b) The existing schemes typically involve a summation using the L−R signal, which creates inverted components (−L in the right and −R in the left) which cannot be controlled separately from the L and R signals.

(c) The stereo enhancement is achieved at the expense of noticeable timbral coloration or delay/interference effects that destroy the natural sound of the signal.

(d) Use of L−R and L+R in the enhancement process requires elaborate feedback and control mechanisms because of the rapidly varying behavior of the sum and difference signals.

(e) The inherent complexity of the sum and difference approach requires special hardware or substantial computational resources to implement.

A need remains in the art of spatial enhancement for apparatus and methods for increasing the perceived dimensions of the sound field while overcoming the above disadvantages.

SUMMARY OF THE INVENTION

An object of the present invention is to provide spatial enhancement apparatus and methods for increasing the perceived dimensions of the sound field.

The present invention emphasizes dissimilarity between the left and right channels by (i) boosting the level of the dissimilar components, (ii) providing spectral equalization to enhance the perception of breadth, and (iii) injecting an equalized, attenuated and inverted version of the dissimilar component into the opposite channel to broaden the component's stereo image. The present invention avoids spectral coloration by providing a generally flat transfer function from input to output.

Interchannel dissimilarity is estimated by performing a first order comparison of the left and right input signals. The comparison may be implemented by a peak detector on the L−R signal, a cross-correlation procedure, or some other scheme.

As a feature, a feedback mechanism alters the equalization characteristics of the signals in a manner that is responsive to the dissimilarity of the output signals. For example, the level of the low frequency components is boosted when the left and right output signals are dissimilar.

If the input signal to the spatial enhancement system is monophonic, a two channel decorrelator is used to generate a pseudo-stereo signal prior to spatial broadening. Each channel of the decorrelator comprises a cascade of all-pass filters which introduce phase dispersion into the two channels.

The invention may be implemented in digital form using special-purpose hardware or a programmable architecture.

DETAILED DESCRIPTION OF THE PREFERRED EMBODIMENT

Figure 1:
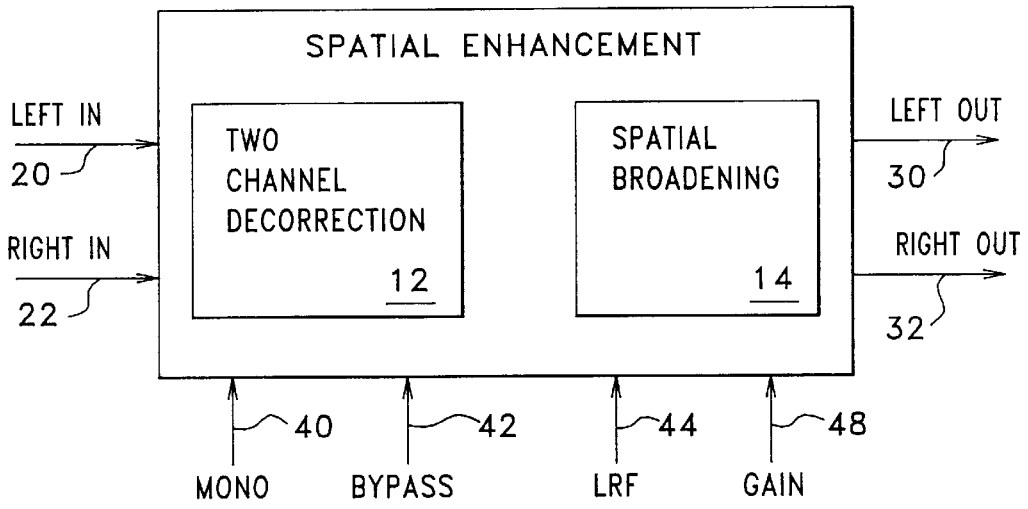
FIG. 1 shows a block diagram of the spatial enhancement system according to the present invention.

FIG. 1 shows a block diagram of spatial enhancement system 10 according to the present invention. Spatial enhancement system 10 includes two main functions, two channel decorrelation 12, for creating pseudo-stereo signals from a mono input signal, and spatial broadening 14, for producing the impression that the stereo sound field has become wider, taller, and deeper. Decorrelator 12 is used only for mono input signals, whereas spatial broadening block 14 is used for both mono and stereo signals.

Input audio signals to spatial enhancement system 10 include left input channel 20 and right input channel 22. For mono signals, channels 20 and 22 are identical. For stereo signals, channels 20 and 22 are the standard left and right channels.

Figure 2:
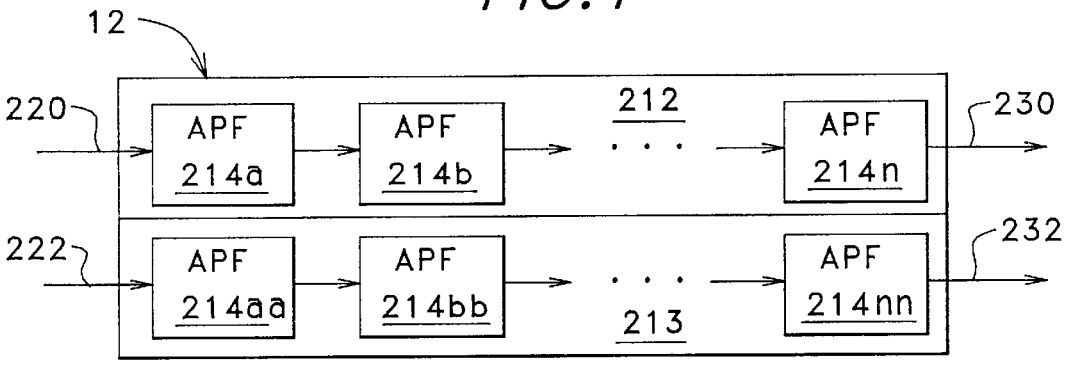
FIG. 2 shows a block diagram of the two channel decorrelation block of FIG. 1.
Figure 3:
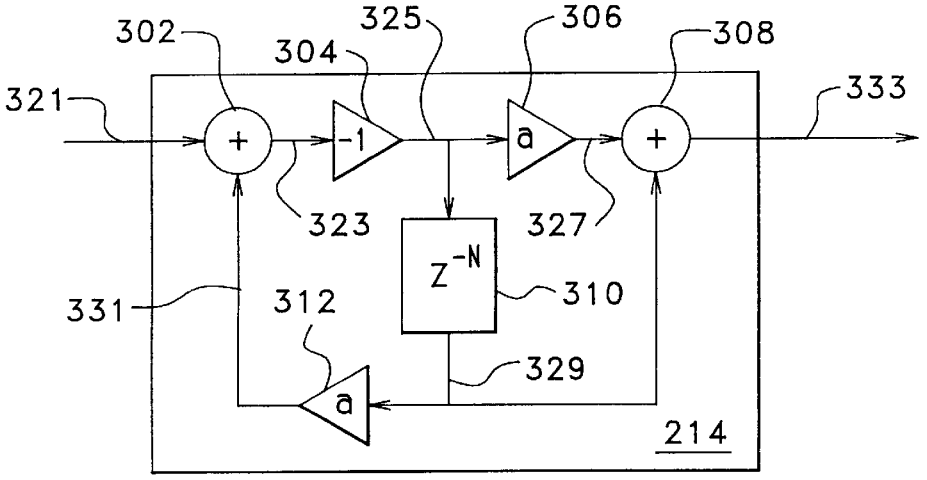
FIG. 3 shows a block diagram of the all pass filters of FIG. 2.

Control signals include mono 40, bypass 42, LRF 44 and gain 48. Mono control signal 40 indicates whether the input audio signal is monophonic or not. If it is monophonic, two channel decorrelation will be done as shown in FIGS. 2 and 3, prior to spatial broadening. If the signal is stereo, decorrelation is unnecessary.

Bypass signal 42 indicates whether spatial enhancement is to be done or not. If bypass is requested, the input samples are simply passed to the output without modification.

The parameter LRF 44 controls the degree of the enhancement effect created by spatial broadening 14. In the preferred embodiment, Gain 48 will be automatically calculated based upon LRF. However, in some applications it may be desirable to allow the user to independently control LRF 44 and Gain 48.

FIG. 2 shows a block diagram of the two channel decorrelation block of FIG. 1. Decorrelator 12 is a mono-to-stereo preprocessor, and is only used when mono control signal 40 indicates that a monophonic input signal is to be decorrelated to produce a pseudo-stereo signal, prior to spatial broadening. Decorrelator 12 is designed to minimize unnatural spectral colorization.

Decorrelation increases the perceived dissimilarity between audio signals without introducing audible spectral or temporal artifacts. In the present invention, decorrelation is accomplished via phase dispersion, i.e. the introduction of different frequency-dependent delays to a pair of signal paths. In order to obtain a largely flat response in the frequency domain, and a dense, aperiodic, impulse response in the time domain, decorrelator 12 involves a cascade of all-pass filters 214 in each signal path. All-pass filters have a flat magnitude response as a function of frequency, but a varying phase response. By cascading all-pass filters with differing delay lengths and filter coefficients the overall perceptual affect is one of diffusion or spaciousness. For the purposes of mono-to-stereo conversion the overall impulse response of the all-pass cascade is limited to less than 60 milliseconds to prevent the subjective impression of reverberation, which would occur for longer impulse responses.

Left input signal 220 enters a cascade 212 of all-pass filters 214*a* through 214*n* to produce left output signal 230. Right input signal 222 enters a second cascade 213 of all-pass filters 214*aa* through 214*nn* to produce right output signal 232. Left and right input signals 220, 222 may be left input signal 20 and right input signal 22, or some other processing may be done prior to decorrelation. Each cascade 212, 213 comprises several (typically 5) all-pass stages 214 of different delay lengths and coefficients. The design choice of delays and coefficients is made to result objectively in a low value of cross correlation and subjectively in an uncolored response.

FIG. 3 shows a block diagram of one type of inverting all-pass filter 214. The form of this all-pass filter is:

$$|H(z)|=|(a+z^{-N})/(1+az^{-N})|,$$

and specifically the inverting all pass filter of FIG. 3 has the form:

$$H(z)=-(a+z^{-N})/(1+az^{-N});$$

where a is the filter coefficient ($-1<a<1$), and N is the length of the delay memory. The N poles of this filter (roots of the denominator, i.e., values of z which make the denominator zero) are located inside the unit circle of the z-plane with uniform angular spacing and radius of $|a|^{N}$. The N zeroes of this filter (roots of the numerator) are located outside the unit circle at the same angles as the poles, but with radius $|a|^{N}$. A direct form structure implementing this filter is shown in FIG. 3.

Input signal 321 is added to feedback signal 331 by adder 302 to form signal 323, which is inverted by block 304 to form signal 325. 325 is scaled by block 306 to form signal 327, which is added to signal 329 by adder 308 to form output signal 333. Signal 325 is also delayed N samples by block 310 to form signal 329. Signal 329 is scaled by block 312 to form signal 331.

Figure 11:
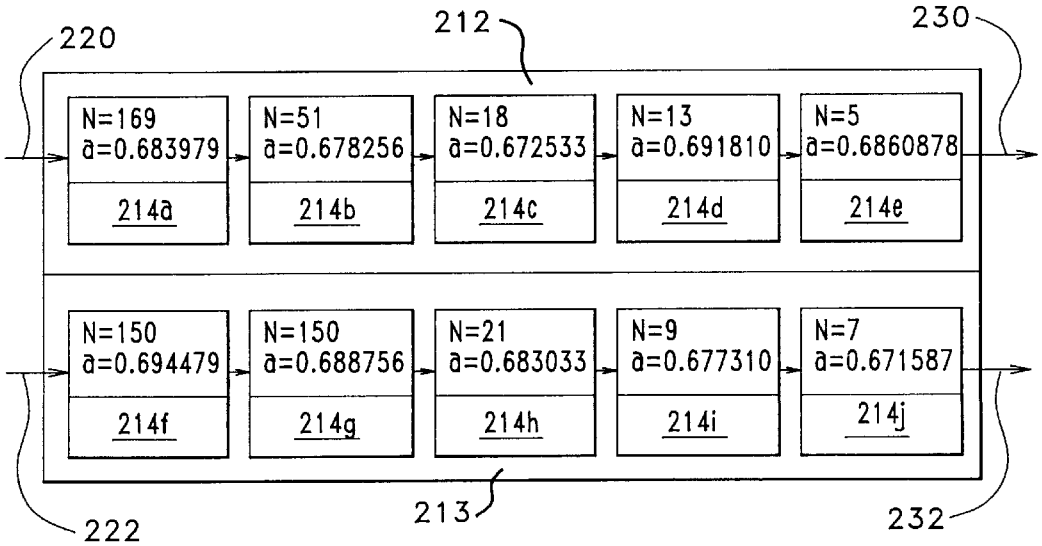
FIG. 11 shows a specific example of the decorrelator of FIG. 2 comprising all pass filter blocks of FIG. 3.

FIG. 11 shows one example of the decorrelator of FIG. 2 using all pass filter blocks as shown in FIG. 3. Left input signal 220 enters a cascade of five all pass filter 214*a–e*, having N and a values as shown in FIG. 11, resulting in left output signal 230. Right input signal 232 enters a cascade of five all pass filter blocks 214*f–j*, having N and a values as shown in FIG. 11, resulting in output signal 232.

Figure 4:
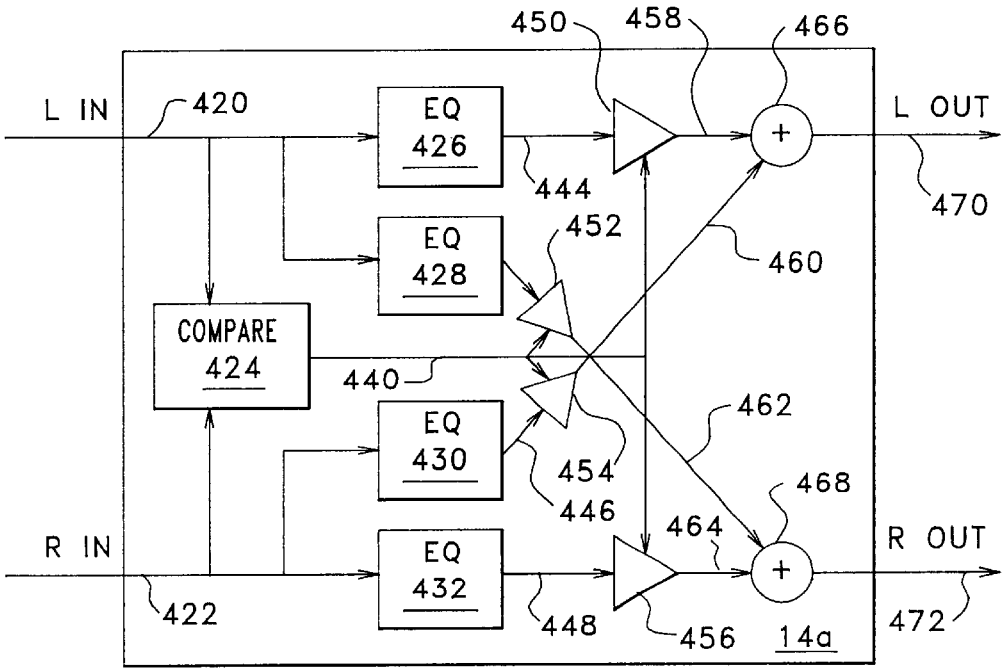
FIG. 4 shows a first embodiment of the spatial enhancement broadening block of FIG. 1.

FIG. 4 shows a block diagram of a first embodiment 14*a* of spatial broadening block 14 of FIG. 1. Spatial broadening produces the impression that the stereo sound field has become wider taller and deeper. This feature simulates a more spacious and natural sonic impression than can be obtained from the conventional closely spaced speakers found, for example, in multimedia personal computers.

Figure 5:
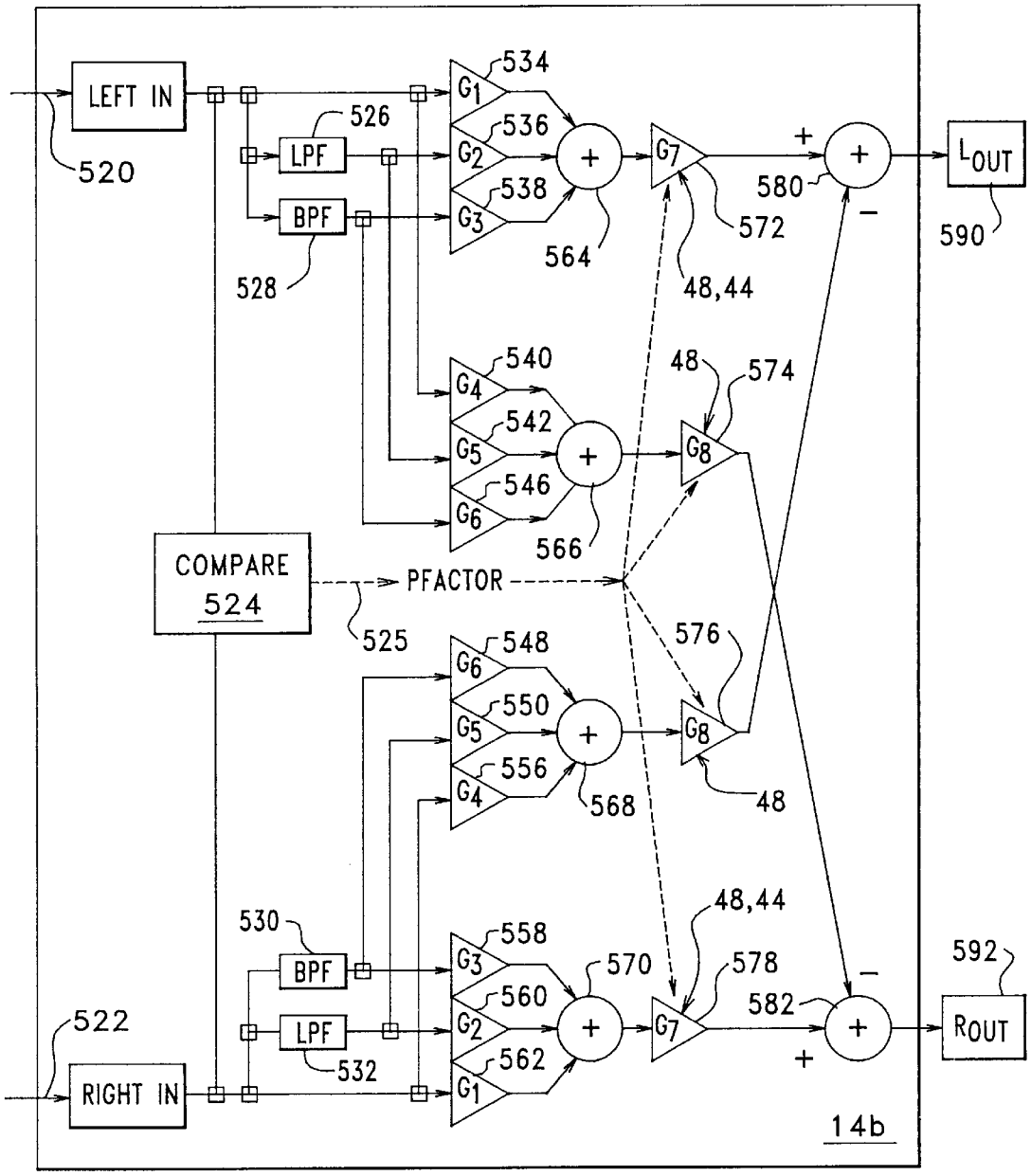
FIG. 5 shows a second embodiment of the spatial broadening apparatus of FIG. 1, incorporating specific filtering and equalization.
Figure 6:
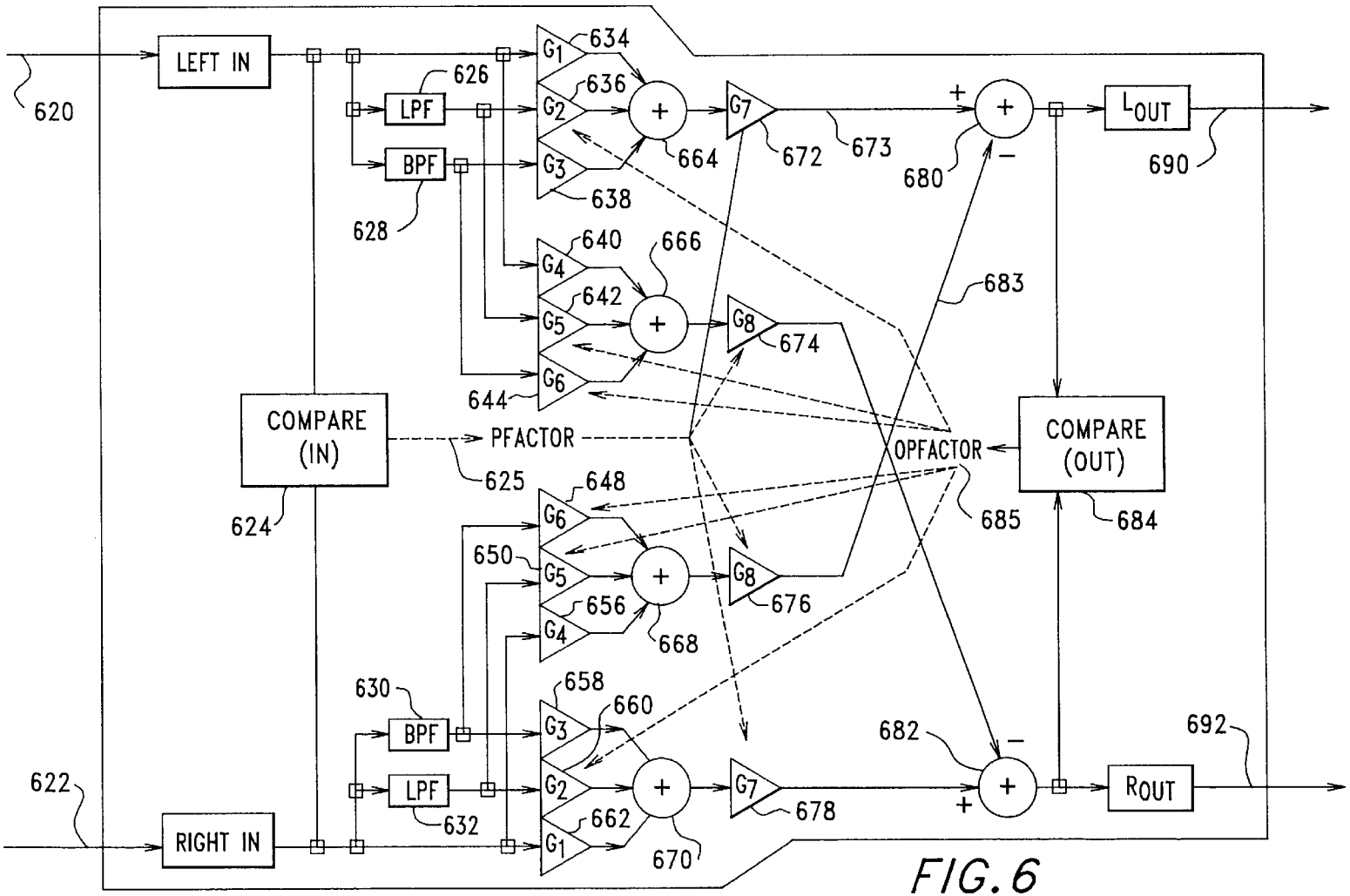
FIG. 6 shows a third embodiment of the spatial broadening apparatus of FIG. 1, further incorporating feedback to alter the equalization characteristics responsive to the dissimilarity in the output channels.

The spatial broadening accomplished by block 14*a*, as well as blocks 14*b* and 14*c* in FIGS. 5 and 6, identifies and boosts dissimilar components in the left and right signals and inserts attenuated and inverted versions of the dissimilar components into the opposite channel. This procedure introduces phase and amplitude effects that would occur naturally for large and widely separated sound sources.

FIG. 4 is based upon a conventional lattice structure, in which the left path combines direct left input signal with cross right input signal, and the right path signal combines direct right input signal with cross left input signal. Each direct and cross signal is separately equalized. In the present invention, after equalization, each direct and cross signal is separately scaled. The scaling of each signal is determined by a control signal which is responsive to the amount of dissimilarity in the left and right paths.

Left input signal 420 and right input signal are routed to compare block 424, which generates a control signal 440, called PFACTOR. Compare 424 may comprise a peak detector responsive to the difference signal L−R, or a correlation circuit which estimates the cross-correlation function between L and R. PFACTOR 440 ranges continuously from zero, when the L and R signals are maximally dissimilar, to some specified maximum value, typically 4, when L and R are equal or nearly equal. PFACTOR 440 is used to control gain blocks 450, 452, 454, and 456.

Left input signal 420 also enters direct equalization block 426, having output signal 442, and cross equalization block 428, having output signal 444. Similarly, right input signal 422 enters direct equalization block 432, having output signal 448, and cross equalization block 430, having output signal 446. Signals 442, 444, 446, and 448 are all scaled by gain blocks 450, 452, 454, and 456 respectively. The amount of gain added by each gain block is related to control signal 440. The relationship between signal 440 and the gain of each gain block 450, 452, 454, 456, may be different. The outputs of gain blocks 450, 452, 454, and 456 are signals 458, 460, 462, and 464. respectively. Left direct signal 458 is added to right cross signal 460 by adder 466 to form left output signal 470. Right direct signal 464 is added to left cross signal 462 by adder 468 to form left output signal 472.

Generally, in the case of dissimilar input signals, the direct path receives more gain than the cross path. When the input signals are similar, the cross paths are emphasized. In this manner any existing dissimilarity of the left and right input signals is maintained if the left and right input signals are strongly dissimilar, or exaggerated if the left and right signals are similar.

Each of the cross paths in FIG. 4 is inverted. Either 452 and 454 are inverting, or the summing junctions they feed are differencing, i.e., 470=458−460 and 472=464−462.

FIG. 5 shows a second embodiment 14*b* of the spatial broadening apparatus. The embodiment of FIG. 5 is similar to the embodiment of FIG. 4, incorporating one specific filtering and equalization scheme.

Left input signal 520 directly enters gain blocks 534 and 540, passes through low pass filter 526 before entering gain blocks 536 and 542, and passes through band pass filter 528 before entering gain blocks 538 and 546. The left direct signals out of gain blocks 534, 536 and 538 are combined by adder 564 and passed to gain block 572. The left cross signals out of gain blocks 540, 542, and 546 are combined by adder 566 and passed to gain block 574.

Similarly, right input signal 522 directly enters gain blocks 556 and 562, passes through low pass filter 532 before entering gain blocks 550 and 560, and passes through band pass filter 530 before entering gain blocks 548 and 558. The right direct signals out of gain blocks 558, 560 and 562 are combined by adder 570 and passed to gain block 578. The right cross signals out of gain blocks 548, 550, and 556 are combined by adder 568 and passed to gain block 576.

As an example, lowpass filters 526 and 532 can be implemented as first order Butterworth filters with Fc=1 kHz. Band pass filters 528 and 530 can be implemented as second order Butterworth filters with Fl=5.2 kHz and Fh=11 kHz (center frequency around 8 kHz). In general, similar or identical equalization schemes are used for the right and left paths.

Left input signal 520 and right input signal 522 are also passed to compare block 524, which compares how similar the two signals are, and generates control signal 525, called PFACTOR, which controls the gain of gain blocks 572, 574, 576, and 578. Thus, the proportions of direct and cross signals combined by adders 580 and 582, and passed to output left signal 590 and output right signal 592, are related to how similar input signals 520 and 522 are.

One example of effective gain block multipliers is given below, where the number in parentheses indicates the gain block, PFACTOR is control signal 525, LRF is control signal 44, and GAIN is control signal 48:

gain (534)=gain (562)=1.1
gain (536)=gain (560)=0.9
gain (538)=gain (558)=1.3
gain (540)=gain (556)=1.0
gain (542)=gain (550)=1.0
gain (546)=gain (548)=1.5
gain (572)=gain (578)=GAIN*(LRF+1.1*PFACTOR)
gain (574)=gain (576)=GAIN*0.9*PFACTOR,
where 0.25<LRF<1.0.

GAIN 48 and LRF 44 effect the gain of blocks 572 and 578, and GAIN 48 effects the gain of blocks 574 and 576 as described in the above equations. The user may either (a) have independent control of the parameters LRF and GAIN, (b) have control of LRF with GAIN calculated according to a formula, such as GAIN=1.35/(LRF+1.1), or (c) have the values of LRF and GAIN predetermined for the user and left unchanged.

Figure 7:
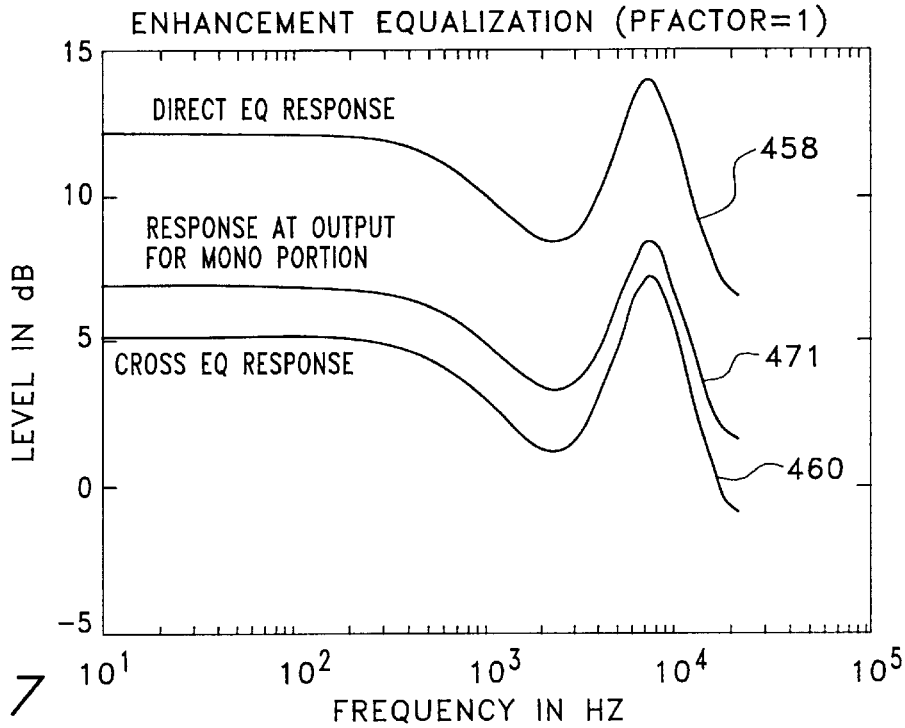
FIG. 7 shows the equalizing behavior of the embodiments of FIGS. 4 and 5 for the case of strongly dissimilar left and right input signals.

In FIG. 7, an example of the equalizing behavior of the embodiments of FIGS. 4 and 5 is shown for the case of strongly dissimilar left and right input signals. The spectral characteristic (frequency response) of signal 458 is shown as the "Direct EQ Response", while the spectral characteristic of signal 460 is shown as the "Cross EQ Response". Signal 471, labeled "Response at Output for Mono Portion," simulates the spectral characteristics of the mono component of the left and right inputs. Note that the level of mono component 471 is reproduced approximately 5 dB lower than the direct path, thereby enhancing the existing differences between the left and right inputs.

A signal component (musical voice) that appears only in the left input channel is affected only by the direct path frequency response on its way to the left output, and affected only by the cross path on its way to the right output, and vice versa for a right-only signal. On the other hand, a signal component that appears equally in the left and right input channels (the "mono" component referred to above) is affected by both the direct path and the cross path on its way to the left and right outputs.

Figure 8:
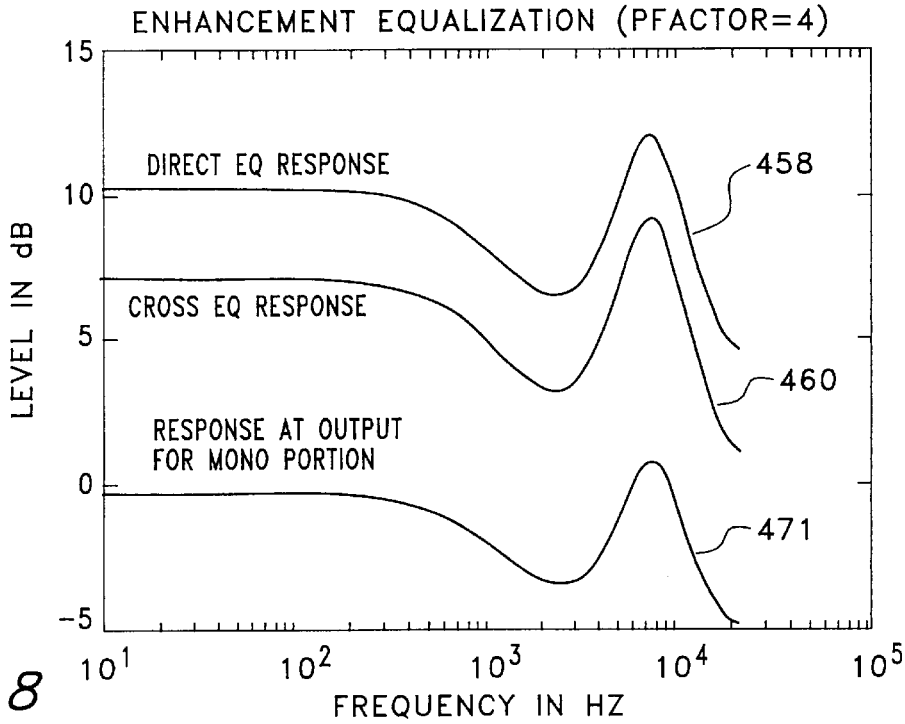
FIG. 8 shows the equalizing behavior of the embodiments of FIGS. 4 and 5 for the case of very similar left and right input signals.

In FIG. 8, an example of the equalizing behavior of the embodiments of FIGS. 4 and 5 is shown for the case of very similar left and right input signals. Again, the spectral characteristic of signal 458 is shown as the "Direct EQ Response", while the spectral characteristic of signal 460 is shown as the "Cross EQ Response". The monophonic component between the left and right input signals, which is relatively strong in the case of very similar left and right input signals, now appears as signal 471 with the spectral characteristic labeled "Response at Output for Mono Portion". Note that the level of this mono component is reproduced approximately 10 dB lower than the direct path, thereby reducing the monophonic component relative to the existing small differences between the left and right inputs.

FIG. 6 shows a third embodiment 14*c* of the spatial broadening apparatus. It incorporates a feedback control signal 684, called OPFACTOR, to alter the equalization characteristics responsive to the dissimilarity in the output channels 690 and 692. The operation of the embodiment of FIG. 6 is very similar to the embodiment of FIG. 5, as described in the next three paragraphs.

Left input signal 620 directly enters gain blocks 634 and 640, passes through low pass filter 626 before entering gain blocks 636 and 642, and passes through band pass filter 628 before entering gain blocks 638 and 646. The left direct signals out of gain blocks 634, 636 and 638 are combined by adder 664 and passed to gain block 672. The left cross signals out of gain blocks 640, 642, and 646 are combined by adder 666 and passed to gain block 574.

Similarly, right input signal 622 directly enters gain blocks 656 and 662, passes through low pass filter 632 before entering gain blocks 650 and 660, and passes through band pass filter 630 before entering gain blocks 648 and 658. The right direct signals out of gain blocks 658, 660 and 662 are combined by adder 670 and passed to gain block 678. The right cross signals out of gain blocks 648, 650, and 656 are combined by adder 668 and passed to gain block 676.

As in the FIG. 5 embodiment, lowpass filters 626 and 632 can be implemented as first order Butterworth filters with Fc=1 kHz. Band pass filters 628 and 630 can be implemented as second order Butterworth filters with Fl=5.2 kHz and Fh=11 kHz (center frequency around 8 kHz).

Left input signal 620 and right input signal 622 are also passed to compare block 624, which compares how similar the two signals are, and generates control signal 625, called PFACTOR, which controls the gain of gain blocks 672, 674, 676, and 678. Thus, the proportions of direct and cross signals combined by adders 680 and 682, and passed to output left signal 690 and output right signal 692, are related to how similar input signals 620 and 622 are.

The embodiment of FIG. 6 has one very important feature which is not included in the embodiment of FIG. 5. In addition to comparing the input signals to determine how similar they are, left output signal 690 is compared to right output signal 692 by compare block 684, to generate control signal 685 (OPFACTOR). OPFACTOR 685 controls the scaling of gain blocks 636, 642, 644, 648, 650, and 660. Thus, the direct and cross signals receive signal dependent spectral equalization by adjustments in the relative gain of the straight, low pass filtered, and band pass filtered bands.

One example of effective gain block multipliers is given below, where the number in parentheses indicates the gain block, PFACTOR is control signal 625, OPFACTOR is control signal 685, LRF is control signal 44, and GAIN is control signal 48:

gain (634)=gain (662)=1.1 gain (636)=gain (660)=0.9*(1+OPFACTOR)

gain (638)=gain (658)=1.3 gain (640)=gain (656)=1.0 gain (642)=gain (650)=1.1(1+0.7*OPFACTOR)

gain (646)=gain (648)=1.5*OPFACTOR gain (672)=gain (678)=GAIN*(LRF+1.1*PFACTOR)

gain (674)=gain (676)=GAIN*0.9*PFACTOR

GAIN 48 and LRF 44 effect the gain of blocks 672 and 678, and GAIN 48 effects the gain of blocks 674 and 676 as described in the above equations. The user of this embodiment may either (a) have independent control of the parameters LRF and GAIN, (b) have control of LRF, with GAIN calculated according to a formula, such as GAIN=1.35/(LRF+1.1), or (c ) have the values for LRF and GAIN predetermined by the manufacturer and left unchanged.

Figure 9:
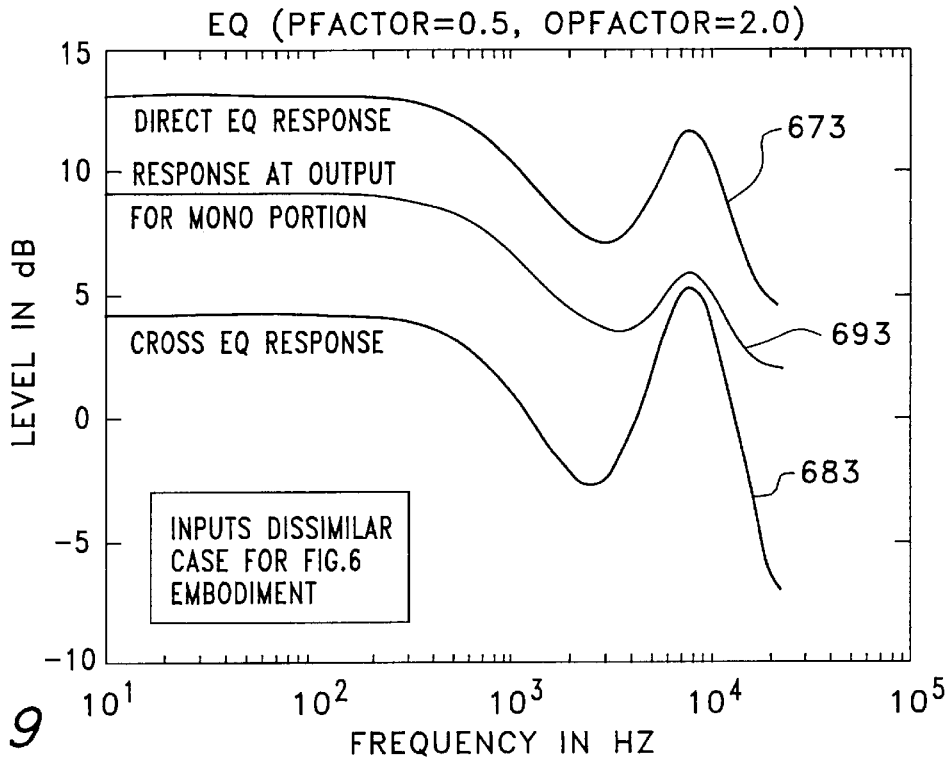
FIG. 9 shows the equalizing behavior of the embodiment of FIG. 6 for the case of strongly dissimilar left and right input signals.

In FIG. 9, an example of the equalizing behavior of the embodiment of FIG. 6 is shown for the case of strongly dissimilar left and right input signals. The spectral characteristic (frequency response) of signal 673 is shown as the "Direct EQ Response", while the spectral characteristic of signal 483 is shown as the "Cross EQ Response". Signal 493, labeled "Response at Output for Mono Portion," simulates the spectral characteristics of the mono component of the left and right inputs. In this case PFACTOR is less than one while OPFACTOR is close to its maximum value (2 in the example given above). Note that 673 is approximately 9 dB greater than 683. This means that existing left and right dissimilarity is maintained since the crossfed component is at a low level. Moreover, 693, the mono component, is maintained at a somewhat lower level than the direct component 673. The operation of the FIG. 6 embodiment when the two channels are dissimilar consists of a spectral shaping function applied to the direct path 673 and minimal gain to the cross path 683, since the channels are already quite different and little additional enhancement is required.

Figure 10:
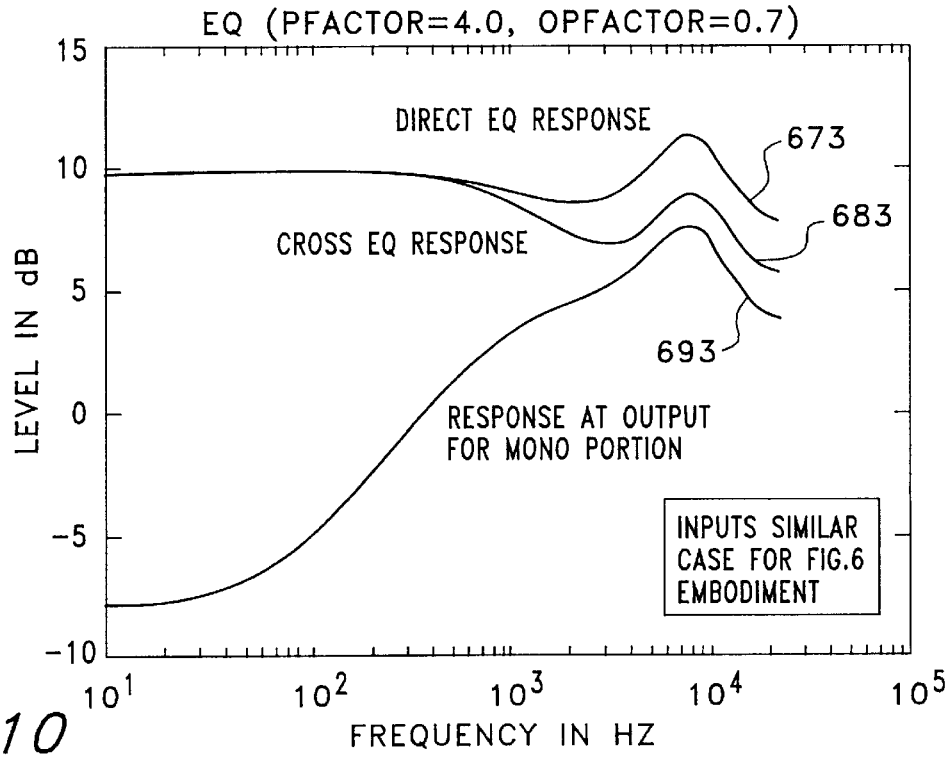
FIG. 10 shows the equalizing behavior of the embodiment of FIG. 6 for the case of very similar left and right input signals.

In FIG. 10, an example of the equalizing behavior of the embodiment of FIG. 6 is shown for the case of very similar left and right input signals. Again, the spectral characteristic of signal 673 is shown as the "Direct EQ Response", while the spectral characteristic of signal 683 is shown as the "Cross EQ Response". PFACTOR is near its maximum value (4 in this example) and OPFACTOR is less than one. In this case the direct and cross signals are boosted by similar factors, resulting in a low mono signal 693 having the spectral characteristic labeled "Response at Output for Mono Portion". Thus, any small differences between the left and right channels are strongly enhanced.

While the exemplary preferred embodiments of the present invention are described herein with particularity, those skilled in the art will appreciate various changes, additions, and applications other than those specifically mentioned, which are within the spirit of this invention.

What is claimed is:

1. Apparatus for spatially enhancing audio signals comprising:

means for providing a first audio input channel and a second audio input channel;

means for dividing the first input audio channel into a first direct path and a first cross path;

means for dividing the second input audio channel into a second direct path and a second cross path;

means for summing the first direct path and the second cross path and providing the sum as a first output signal;

means for summing the second direct path and the first cross path and providing the sum as a second output signal;

means for applying equalization to the first direct path;

means for applying equalization to the second direct path;

output comparing means for comparing the first and second output signals to determine a level of similarity between the first and second output signals and generating a control signal based upon the level of similarity; and means for regulating at least one of the means for applying equalization to the first direct path and means for applying equalization to the second direct path according to the control signal.

2. Apparatus for spatially enhancing audio signals comprising:

means for providing a first audio input channel and a second audio input channel;

input comparing means for comparing the first and second audio input channels to determine a level of similarity between the first and second input channels and a first control signal based upon the level of similarity;

means for dividing the first input audio channel into a first direct path and a first cross path;

means for dividing the second input audio channel into a second direct path and a second cross path;

first applying means responsive to the first control signal for applying a gain to at least one of the first direct path, the first cross path, the second direct path, or the second cross path based upon the first control signal;

means for summing the first direct path and the second cross path and providing the sum as a first output signal;

means for summing the second direct path and the first cross path and providing the sum as a second output signal; and means for inverting the first and second cross paths;

wherein the first applying means increases the gain applied to the first and second direct paths compared to the gain applied to the first and second cross paths as the level of similarity decreases, and increases the gain applied to the first and second cross paths compared to the gain applied to the first and second direct paths as the level of similarity increases;

means for applying equalization to the first direct path; and means for applying equalization to the second direct path;

wherein the means for applying equalization to each of the first direct path and the second direct path comprises:

means for splitting each path into three branches;

means for applying a branch gain to the first branch;

means for applying a low pass filter and a branch gain to the second branch;

means for applying a band pass filter and a branch gain to the third branch; and means for recombining the first, second, and third branches of each path.

3. The spatial enhancement apparatus of claim 2, further including:

output comparing means for comparing the first and second output signals to determine a level of similarity between the first and second output signals and generating a second control signal based upon the level of similarity; and means for adjusting at least one of the branch gains according to the second control signal.

4. Apparatus for spatially enhancing audio signals comprising:

means for providing a first audio input channel and a second audio input channel;

means for dividing the first input audio channel into a first direct path and a first cross path;

means for dividing the second input audio channel into a second direct path and a second cross path;

means for summing the first direct path and the second cross path and providing the sum as a first output signal;

means for summing the second direct path and the first cross path and providing the sum as a second output signal;

means for applying equalization to the first cross path;

means for applying equalization to the second cross path;

output comparing means for comparing the first and second output signals to determine a level of similarity between the first and second output signals and generating a control signal based upon the level of similarity; and means for regulating at least one of the means for applying equalization to the first cross path and means for applying equalization to the second cross path according to the control signal.

5. The spatial enhancement apparatus of claim 4, further including:

means for applying equalization to the first direct path; and means for applying equalization to the second direct path.

6. The spatial enhancement apparatus of claim 5, further comprising:

means for regulating at least one of the means for applying equalization to the first direct path and second direct path according to the control signal.

7. The spatial enhancement apparatus of claim 6, wherein the means for applying equalization to each of the first direct path, the second direct path, the first cross path and the second cross path comprises:

means for splitting each path into three branches;

means for applying a branch gain to the first branch;

means for applying a low pass filter and a branch gain to the second branch;

means for applying a band pass filter and a branch gain to the third branch; and means for recombining the first, second, and third branches of each path.

8. Apparatus for spatially enhancing audio signals comprising:

means for providing a first audio input channel and a second audio input channel;

input comparing means for comparing the first and second audio input channels to determine a level of similarity between the first and second input channels and a first control signal based upon the level of similarity;

means for dividing the first input audio channel into a first direct path and a first cross path;

means for dividing the second input audio channel into a second direct path and a second cross path;

first applying means responsive to the first control signal for applying a gain to at least one of the first direct path, the first cross path, the second direct path, or the second cross path based upon the first control signal;

means for summing the first direct path and the second cross path and providing the sum as a first output signal;

means for summing the second direct path and the first cross path and providing the sum as a second output signal; and means for inverting the first and second cross paths;

wherein the first appiving means increases the gain applied to the first and second direct paths compared to the gain applied to the first and second cross paths as the level of similarity decreases, and increases the gain applied to the first and second cross paths compared to the gain applied to the first and second direct paths as the level of similarity increases;

means for applying equalization to the first cross path; and means for applying equalization to the second cross path;

wherein the means for applying equalization to each of the first cross path and the second cross path comprises:

means for splitting each path into three branches;

means for applying a branch gain to the first branch;

means for applying a low pass filter and a branch gain to the second branch;

means for applying a band pass filter and a branch gain to the third branch; and means for recombining the first, second, and third branches of each path.

9. The spatial enhancement apparatus of claim 8, further including:

output comparing means for comparing the first and second output signals to determine a level of similarity between the first and second output signals and generating a second control signal based upon the level of similarity; and means for adjusting at least one of the branch gains according to the second control signal.

10. Apparatus for producing a pseudo-stereo signal from a monophonic audio signal, said apparatus comprising:

means for providing the monophonic audio input signal to first and a second audio input channel; and means for introducing different frequency dependent phase shifts into the first and second input channel;

wherein said means for introducing includes:

a first cascade of all pass filters applied to the first input channel; and a second cascade of all pass filter applied to the second input channel; the second cascade having different filter characteristics than the first cascade; and wherein some of the all pass filters have the form $|H(z)|=|(a+z^{-n})/(1az^{-n})|$;

wherein a is the filter coefficient $(-1<a<1)$, N is the lenght of the delay memory, the N poles of the filters are located inside the unit circle of the z-plane with uniform angular spacing and radius of $|a|^{N}$, and N zeroes of the filters are located outside the unit circle at the same angles as the poles, but with radius $|a|^{-N}$.

11. The apparatus of claim 10 wherein:

some of the all pass filters have the form $H(z)=-(a+z^{-N})/(1+az^{-n})$;

where a is the filter coefficient $(-1<a<1)$, N is the length of the delay memory, the N poles of the filters are located inside the unit circle of the z-plane with uniform angular spacing and radius of $|a|^{N}$, and the N zeroes of the filters are located outside the unit circle at the same angles as the poles, but with radius $|a|^{-N}$.

12. The apparatus of claim 10 wherein the first cascade comprises five all pass filters and the second first cascade comprises five all pass filters.

13. Apparatus for spatially enhancing audio signals comprising:

means for providing a first audio input channel and a second audio input channel;

input comparing means for comparing the first and second audio input channels to determine a level of similarity between the first and second input channels and generating a first control signal based upon the level of similarity;

means for dividing the first input audio channel into a first direct path and a first cross path;

means for dividing the second input audio channel into a second direct path and a second cross path;

gain applying means responsive to the first control signal for applying a gain to at least one of the first direct path, the first cross path, the second direct path, or the second cross path based upon the first control signal;

means for summing the first direct path and the second cross path and providing the sum as a first output signal;

means for summing the second direct path and the first cross path and providing the sum as a second output signal;

wherein the gain applying means increases the gain applied to the first and second direct paths compared to the gain applied to the first and second cross paths as the level of similarity decreases, and increases the gain applied to the first and second cross paths compared to the gain applied to the first and second direct paths as the level of similarity increases;

output comparing means for comparing the first and second output signals to determine a level of similarity between the first and second output signals and generating a second control signal based upon the level of similarity;

means for applying equalization to at least one of the paths; and means responsive to the second control signal for modifying the equalization applied to at least one of the paths.

14. The spatial enhancement apparatus of claim 13, further comprising:

decorrelating means for decorrelating the first and second audio input channels including means for introducing different frequency dependent phase shifts into the first and second input channels.

* * * * *

UNITED STATES PATENT AND TRADEMARK OFFICE

CERTIFICATE OF CORRECTION

PATENT NO. : 6,111,958
DATED : August 29, 2000
INVENTOR(S) : Rob Maher

It is certified that error appears in the above-identified patent and that said Letters Patent is hereby corrected as shown below:

Column 10,
Line 52, delete "appiving" and insert -- applying --.

Column 11,
Line 16, between 'to' and 'first' insert -- a --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*